US010668440B2

(12) United States Patent
Green et al.

(10) Patent No.: US 10,668,440 B2
(45) Date of Patent: Jun. 2, 2020

(54) DUST REDUCING TREATMENT FOR PROPPANTS DURING HYDRAULIC FRACTURING OPERATIONS

(71) Applicant: Hexion Inc., Columbus, OH (US)

(72) Inventors: John W. Green, Cypress, TX (US); Jerome F. Borges, Richmond, TX (US); Scott E. Spillars, Houston, TX (US); Regie Ahmad, Houston, TX (US); Justin Niles, Cypress, TX (US); Leo Elder, Tomball, TX (US); Adrian Barajas, Houston, TX (US); Chris E. Higganbotham, Sugar Land, TX (US)

(73) Assignee: Hexion Inc., Columbus, OH (US)

( * ) Notice: Subject to any disclaimer, the term of this patent is extended or adjusted under 35 U.S.C. 154(b) by 0 days.

(21) Appl. No.: 14/739,612

(22) Filed: Jun. 15, 2015

(65) Prior Publication Data

US 2015/0360188 A1 Dec. 17, 2015

Related U.S. Application Data

(60) Provisional application No. 62/013,329, filed on Jun. 17, 2014.

(51) Int. Cl.

| | |
|---|---|
| ***B01F 15/00*** | (2006.01) |
| ***B01F 13/00*** | (2006.01) |
| ***B01F 15/06*** | (2006.01) |
| ***B01F 3/12*** | (2006.01) |

(52) U.S. Cl.
CPC ..... *B01F 15/00961* (2013.01); *B01F 3/1228* (2013.01); *B01F 13/004* (2013.01); *B01F 15/00428* (2013.01); *B01F 15/067* (2013.01); *B01F 2015/062* (2013.01); *B01F 2215/0081* (2013.01)

(58) Field of Classification Search
CPC ..... B01F 13/004; B01F 15/00428; B01F 2215/0081; B01F 15/00961; B01F 15/067; B01F 2015/062; B01F 3/1228
See application file for complete search history.

(56) References Cited

U.S. PATENT DOCUMENTS

| | | | | | |
|---|---|---|---|---|---|
| 4,616,934 | A * | 10/1986 | Brock | E01C 19/1004 | 366/22 |
| 4,886,367 | A * | 12/1989 | Bragg | B01F 3/088 | 366/132 |
| 4,946,283 | A * | 8/1990 | Musil | E01C 19/1004 | 366/147 |
| 5,002,398 | A * | 3/1991 | Musil | E01C 19/1004 | 366/147 |
| 5,083,870 | A * | 1/1992 | Sindelar | E01C 19/10 | 34/137 |
| 5,620,249 | A * | 4/1997 | Musil | B28C 5/4282 | 34/136 |
| 6,193,402 | B1 * | 2/2001 | Grimland | B01F 3/1221 | 366/14 |

(Continued)

*Primary Examiner* — Tony G Soohoo

(57) ABSTRACT

Dust produced by handling proppant during fracking or other mechanical operations can be a health and/or safety hazard. The dust can be eliminated or at least mitigated using a method of conducting a hydraulic fracturing or other mechanical operation on an oil or gas well including treating a proppant that has been transported to an end use site at a level sufficient to prevent the formation of dust during handling of the proppant.

21 Claims, 3 Drawing Sheets

(56) References Cited

U.S. PATENT DOCUMENTS 6,196,710 B1 * 3/2001 Swanson ..... E01C 19/1031 34/131
6,412,974 B1 * 7/2002 Scholl ..... B01F 13/0035 366/191
6,876,904 B2 * 4/2005 Oberg ..... B01F 15/0479 366/17
7,135,231 B1 * 11/2006 Sinclair ..... C09K 8/805 427/404
7,384,181 B1 * 6/2008 Collette ..... E01C 19/1004 366/147
7,566,162 B1 * 7/2009 Swanson ..... C08L 95/00 366/15
8,882,336 B1 * 11/2014 Wolford ..... B01F 3/12 366/34
2002/0001255 A1 * 1/2002 Flood ..... B28C 7/0486 366/8
2003/0002384 A1 * 1/2003 Flood ..... B28C 7/0486 366/7
2004/0008571 A1 * 1/2004 Coody ..... B01F 3/1221 366/154.1
2007/0036977 A1 2/2007 Sinclair et al.
2007/0226089 A1 * 9/2007 DeGaray ..... B28C 7/02 705/28
2009/0303828 A1 * 12/2009 Van Zante ..... B01F 13/0035 366/8
2009/0316518 A1 * 12/2009 Goldsmith ..... B01F 3/12 366/134
2010/0027371 A1 * 2/2010 Lucas ..... B01F 3/1271 366/134
2010/0038077 A1 * 2/2010 Heilman ..... E21B 21/062 166/250.01
2011/0305101 A1 * 12/2011 Brouillette ..... B01F 3/12 366/34
2012/0127822 A1 * 5/2012 Noles, Jr. ..... B01F 3/0865 366/152.2
2012/0140590 A1 * 6/2012 Kirschner ..... B67D 3/0038 366/152.2
2013/0233439 A1 9/2013 Stutzman et al.
2013/0292122 A1 * 11/2013 Nichols ..... E21B 43/26 166/308.1
2014/0096974 A1 * 4/2014 Coli ..... E21B 43/26 166/358
2014/0110425 A1 4/2014 Pahl et al.
2014/0364346 A1 * 12/2014 Weinstein ..... B01F 3/1271 507/225
2015/0146499 A1 * 5/2015 Crabb ..... B65D 88/128 366/191
2015/0165393 A1 * 6/2015 Schuster ..... B28C 7/064 366/6
2015/0231584 A1 * 8/2015 Barton ..... B01F 15/0404 366/152.1
2015/0322761 A1 * 11/2015 Hodgson ..... E21B 43/267 166/308.1
2015/0360188 A1 * 12/2015 Green ..... B01F 15/00961 366/137

* cited by examiner

DUST REDUCING TREATMENT FOR PROPPANTS DURING HYDRAULIC FRACTURING OPERATIONS

RELATED APPLICATION DATA

This application claims benefit to U.S. Provisional Application No. 62/013,329 filed Jun. 17, 2014, of which the entire contents of the application are incorporated by reference herein.

BACKGROUND OF THE INVENTION

Field of the Invention

The present invention relates to a method for reducing or mitigating the production of dust from the handling of the proppants. The present invention particularly relates to a method for reducing or mitigating the production of dust from the handling of the proppants during a hydraulic fracturing operation, a system for doing so.

Background of the Art

Historically, hydraulic fracturing has been used for decades to stimulate production from oil and gas wells. Generally speaking, hydraulic fracturing, commonly referred to as fracking, consists of pumping fluid into a wellbore at high pressure. Inside the wellbore, the fluid is forced into the formation being produced. When the fluid enters the formation, it fractures, or creates fissures, in the formation.

In some instances, solid proppants are then dispersed in a fluid and the resulting slurry is pumped into the fissures to stimulate the release of oil and gas from the formation. They serve to hold the fissures open and, depending upon the type of proppant used, may serve other functions.

The proppants used in hydraulic fracturing operations are typically stored in sand bins, surge pits, tanks or other proppant storage devices. As the proppant is deposited therein or upon its exit, a large amount of dust may be propagated. Generally, the dust may accumulate therein or even exit into the environment. In either case, this dust can create dangerous conditions.

For example, in open sand bins, the dust may leave the sand bin and spread to surrounding areas, causing health hazards to people in the vicinity of the fracturing operation. If the dust remains within the container, it may become subject to explosion or cause excessive static charge accumulations. It would be desirable in the art of providing proppants for fracking operations to not have excessive dust produced.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

SUMMARY OF THE INVENTION

Figure 1:
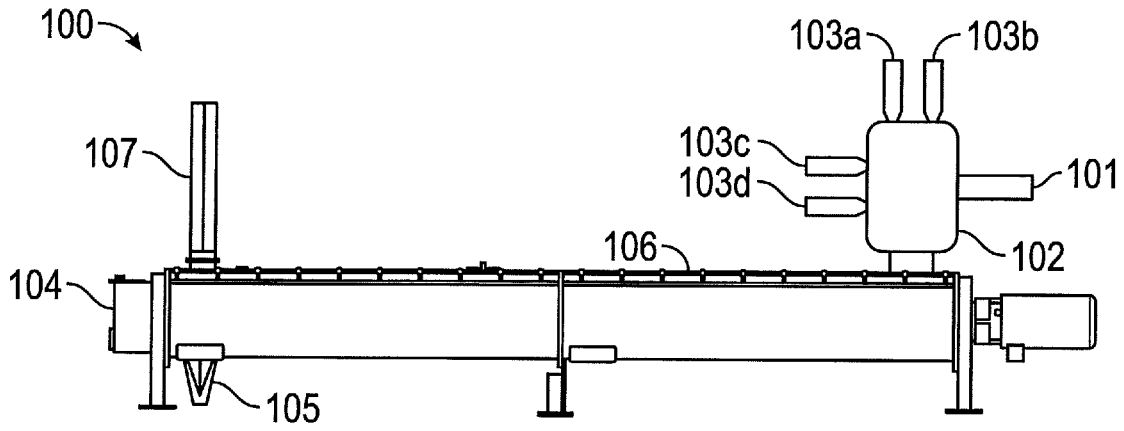
FIG. 1 is a schematic view of a mixing unit useful with the method of the application.

In one aspect, the invention is a method of conducting a hydraulic fracturing operation on an oil or gas well including treating a proppant that has been transported to a well site with a chemical coating at level sufficient to prevent or at least mitigate the formation of dust during handling of the proppant.

The coating components used to make the dust control agent is one or more compounds selected from the group consisting of water, surfactants, glycol ethers, soaps, fatty acids, silicones and modified silicones, epoxies, acrylic polymers, phenolics, polyurethanes, polyacrylamides, fluoropolymers, gums, resins, thermoplastics, rubbers, elastomers, thermoplastic elastomers, synthetic rubbers, liquid or liquefiable organic surface active agents, and combinations thereof. The proppants may be treated at a rate of 1,000 lbs/hr to about 200,000 lbs/hr, such as at a rate of 40,000 lbs/hr to about 70,000 lbs/hr.

In another aspect, the invention is a system for coating a proppant that has been transported to a well site with a chemical coating, the system comprising a metering device configured to receive the proppant; a mixer configured to receive the proppant from the metering device, wherein the mixing device is further configured to receive at least one liquid or solid feed stream of chemical coating compound. In some embodiments, the metering device may not be present.

In still another aspect, the invention is a system for coating a proppant that has been transported to a well site with a chemical coating, the system comprising a metering device configured to receive the proppant; a mixer configured to receive the proppant from the metering device, wherein the mixing device is further configured to receive at least one liquid or solid feed stream of chemical coating compound, and substantially the entirety of the system is integrated within a vehicle, disposed on a vehicle, or disposed within a container which can be placed upon a vehicle.

In still another aspect, the invention is a mobile system for treating a proppant, the system including a metering device configured with two or more inlet ports to receive a proppant and one or more material streams selected from the group of liquid feed streams, solid feed streams, and combinations thereof and a mixer coupled to the metering device and configured to receive materials from the metering device, wherein the mobile system is disposed within a container which can be placed upon or coupled to a vehicle, is disposed on a vehicle, or is integrated within a vehicle.

In still another aspect, the invention is a mobile system for treating a proppant the system, comprising a metering device configured to receive a proppant, and a mixer wherein the mixer configured to be coupled to the metering device and configured to receive materials from the metering device, and coupled to one or more material sources selected from the group of liquid sources, solid sources, and combinations thereof, wherein the mobile system is disposed within a container which can be placed upon or coupled to a vehicle, is disposed on a vehicle, or is integrated within a vehicle.

DESCRIPTION OF THE PREFERRED EMBODIMENTS

In one embodiment, the invention is a method of conducting a hydraulic fracturing operation on an oil or gas well including treating a proppant that has been transported to a well site with a chemical coating at level sufficient to prevent or at least mitigate the formation of dust during handling of the proppant. The proppants that may be used with the method of the application include any known to be useful to those of ordinary skill in the art of fracking. The proppants may be selected from the group consisting of sand, ceramics, sintered bauxite, and combinations thereof, of which proppant may be also be resin coated proppant prior to processing with a coating as described herein.

While any proppant may be used, in some embodiments it is desirable to use proppants of a specific size range. Typical proppant sizes are generally between 8 and 140 mesh (2.38 mm-0.105 mm), for example between 16 and 30 mesh (1.19 mm-0.595 mm), between 20 and 40 mesh (0.841 mm-0.4 mm), between 30 and 50 mesh (0.595 mm-0.297 mm), between 40 and 70 mesh (0.4 mm-0.21 mm), between 60 and 140 mesh (0.25 mm-0.105 mm) or between 70 and 140 mesh (0.21 mm-0.105 mm). For example, in one embodiment, it is preferable that the proppant be about 100 mesh (0.149 mm). In other embodiments, it is desirable that the proppants be about 14 mesh (1.41 mm). Proppants having sizes between 8 and 400 (0.037 mm) mesh may also be used with the method of the application.

References to proppant size in the paragraph immediately above are not the only way in which proppants may be characterized. For example in some applications a sieve range may be used. 20/40 is one such sieve range. Sometimes, end users may even use a shorthand such as describing a proppant as being 100 mesh when in reality it is actually a 70/140 mesh cut. For the purposes of this application, any proppant which causes a dust problem may be used no matter how it is characterized by the various end users.

Dust control agents that may be used with the method of the application include, but are not limited to surfactants, gums, resins, thermoplastics, rubbers including synthetic rubbers, elastomers, thermoplastic elastomers, siloxanes, silicones and modified silicones, and combinations thereof, which can be applied to the surface of the proppant. Suitable dust control agents include glycol ethers, soaps, fatty acids, epoxies, acrylic polymers, phenolics, polyurethanes, polyacrylamides, fluoropolymers, polysiloxanes, and combinations thereof.

Examples of dust control agents include, but not limited to, aminoethylaminopropyl polysiloxane emulsion, emulsion of dimethylhydroxyterminated siloxanes and silicones, aqueous polysiloxane emulsion, polydimethylsiloxane emulsion, alkyl branched and vinyl polysiloxanes, dimethiconol emulsion, toluene solution of polysiloxane gum and resin, anionic emulsion of carboxylated styrene butadiene, Oil Well Resin 9200 phenolic resin, SL-1116E phenolic resin, OWR-262E phenolic resin, Synthebond 9300 resin, Snowtack 100G (stabilized rosin ester), Pinerez 2490 (rosin ester), Neoprene 571 (anionic colloidal dispersion of polychloroprene in water), AK 12500 silicone fluid (polydimethylsiloxane), and combinations thereof.

In addition to the single component coatings, combinations of coatings can be used. For example, 2 or more of phenol-aldehyde resins, melamine-aldehyde resins, resole and novolac resins, urea-aldehyde resins, epoxy resins, furan resins, urethane resins may be employed. Any resin known to be useful to those of ordinary skill in the art may be employed, such as all those listed in the U.S. Pat. No. 7,270,879; which is fully incorporated herein by reference, may be so used.

In addition to the resins already referenced other copolymers may be employed. For example, silicone and styrene copolymers may be used.

Any coating, no matter how simple or complex may be used as long as the coating includes at least one component that: (1) helps suppress dust formation and prevent flowback such as a resin, (2) inhibits the formation of dust by mitigating abrasion (a dust forming condition) such as a tackfier or a pressure sensitive adhesive; or (3) a compatibilizing component that facilitates applying the other components to the proppant, such as a surfactant.

In regard to the latter components, surfactants for imparting water wettability during handling in surface operations include nonionic surfactants, zwitterionic surfactants, and combinations thereof. Suitable surfactants include, but are not limited to alkane diols, ethoxylated acetylenic diols, betaines, and combinations thereof. An example of an alkane diol surfactant is Surfynol® AD01 surfactant, commercially available from Air Products of Allentown, Pa. An example of an ethoxylated acetylenic diol is Dynol™ 800 surfactant, commercially available from Air Products of Allentown, Pa. An example of a betaine is Chembetaine CAS, cocamidopropyl hydroxysultaine, surfactant, commercially available from Lubrizol of Cleveland, Ohio. Additionally, anionic surfactants, cationic surfactants, amphoteric surfactants, zwitterionic surfactants or combinations or mixtures thereof may also be used with or in place of the non-ionic surfactants. Suitable anionic surfactants include sulfosuccinates such as AEROSOL® OT-70 PG surfactant and AEROSOL® OT-75 PG surfactant from Cytec of Woodland Park, N.J.

An acid catalyst may be added for resin curing. Suitable curing catalysts include acids with a pKa of about 4.0 or lower, such as a pKa from about −3 to about 3. Suitable acid catalysts include phosphoric acid, sulfuric acid, nitric acid, benzenesulfonic acid, toluenesulfonic acid, p-toluenesulfonic acid, xylenesulfonic acid, methanesulfonic acid, sulfamic acid, oxalic acid, salicylic acid and combinations thereof. The curing catalyst may also include chemical variations and derivative of the acids, for example p-toluenesulfonic acid. An acid such as an aqueous solution of ammonium chloride would also be suitable as a catalyst. One example of a suitable catalyst is 65% p-toluenesulfonic acid available from available as 6510W70 from DynaChem of Westville, Ill. The acid catalyst is added in amount from about 0.01 wt. % to about 1.0 wt. % of the coated proppant weight.

Additional components that may be added to the coating process include adhesion promoters (also referred to as coupling agents), solvents, reactive diluents, free radical initiators, and combinations thereof. Such additional components may be added in amount from about 0.1 wt. % to about 1.0 wt. % of the coated proppant weight. An example of an adhesion promoter is (3-glycidyloxypropyl)trimethoxysilane. An example of a solvent is toleune. Examples of reactive diluents include styrene, alpha-methylstyrene or divinylbenzene and combinations thereof. Free radical initiators may include organic peroxides, for example, benzoyl peroxide, dicumyl peroxide, 2,5-di(tert-butylperoxy)-2,5-dimethyl-3-hexyne, and combinations thereof. The benzoyl peroxide is expected to improve the strength of the polysiloxane gum and resin of PSA6573A via peroxide-induced crosslinking. The organic peroxide initiator is added at about 1 to about 4% by weight of PSA solids.

The dust control agents, in some embodiments, may be present on the proppant from about 0.01 to about 5 wt % of the total weight of the proppant and dust control agent. In other embodiments, it may be from about 0.05 to about 2 wt. %. In still other embodiments, it may be from about 0.10 to about 1.65 wt. %, for example from about 0.10 to about 1.5 wt. %. In all embodiments, the amount of dust control agent is selected to reduce dust generation. In some embodiment, the amount (and coating composition/formulation) may also be selected to impart flowback control of the proppant being treated. For the purposes of this application, the term flow back means the undesirable flow of proppant from the formation back to the wellbore after completion of a stimulation treatment utilizing the proppant and associated fluids. Flowback control is a characteristic of the coated proppants which often will have a tacky surface allowing them to adhere to the formation and/or to bond/adhere to one another more readily and thus not be flowed back into the wellbore.

The proppants may be treated at a rate of 1,000 lbs/hr to about 200,000 lbs/hr, such as at a rate of 40,000 lbs/hr to about 70,000 lbs/hr.

In another embodiment, the invention is a system for treating proppant that has been transported to a well site by applying a chemical coating, the system comprising a metering device configured to receive the proppant; a mixer configured to receive the proppant from the metering device, wherein the mixing device is further configured to receive at least one liquid or solid feed stream of chemical coating compound. One element of this embodiment is illustrated in FIG. 1.

Figure 4:
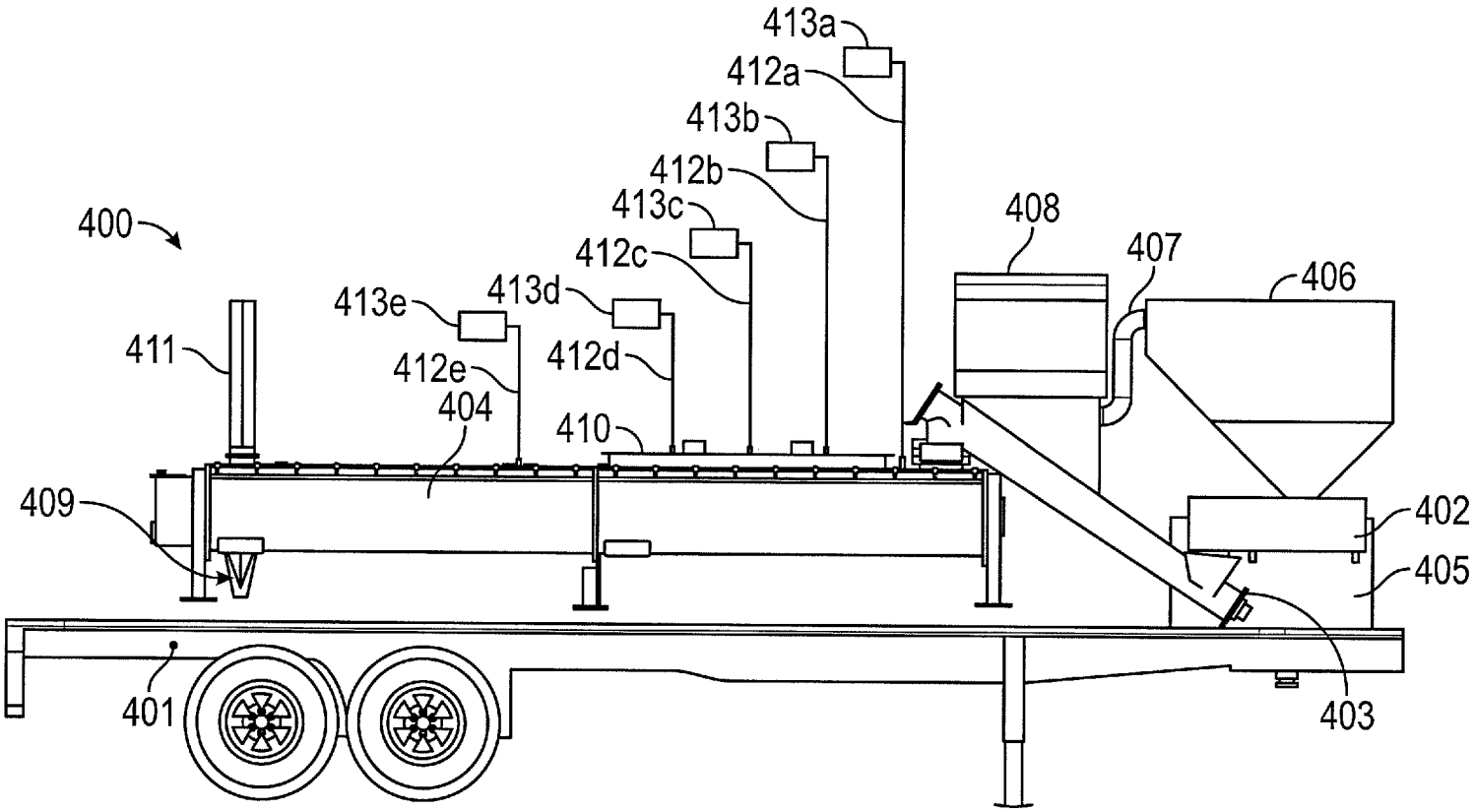
FIG. 4 is an illustration of one embodiment of the mobile system of the application.

Turning to FIG. 1, metering device (102) is shown with an inlet (101) for proppant to enter the mixer (104). The proppant inlet is incorporated into a metering device (102). The metering device may have from 2 or more inlet ports (103), such as from 2 to 10 inlet ports, such as 4 or 6, for introducing chemicals, including the dust control agents described herein, into the metering device. Any number of ports may be used, depending upon the complexity of the dust control agent. Alternatively, the inlet ports for introducing chemicals may be provided directly to the mixer, such as shown in FIG. 4. The ports provide for fluidly coupling the chemicals from the respective sources to the metering device, or alternatively, the mixer. The metering devices for the various chemicals may be located in a separate chemical truck that holds the chemicals for delivery into the mixing unit. Alternatively, the chemicals and metering devices for the chemicals may be in the same unit/container as the mixer.

In one embodiment, as shown in FIG. 1, the inlet ports to the metering device are four chemical inlet ports (103*a-d*). For example, in one embodiment, the inlet and inlet ports for the metering device may allow for a proppant inlet (101), for example, introducing sand, a resin inlet port (103*a*), for example, introducing resole resin (optionally including an acid catalyst for resin curing in the same or different inlet port), a coupling agent inlet port (103*b*), for example, introducing silane, a dust control inlet port (103*c*), for example, introducing a silicone dust control agent, and a surfactant inlet port (103*d*).

The mixer is coupled to the metering device. In the configuration shown in FIG. 1, the metering device is shown as sitting on/above the mixer (104) which allows the proppant to flow via a gravity feed process or a mechanical feed system. Finally, this embodiment shows an outlet port (105) which is configured to allow coated proppant to leave the mixer. During the practice of the methods of the application, some or all of the inlets may be used. The outlet port (105) may be coupled to the use site, such as a wellbore at a wellsite, through hoses, piping, or other delivery systems know in the industry.

An optional heating unit, such as heating unit (106) may be disposed on the mixer. Further, while not shown, one or more of the delivery lines may be connected directly to the mixer, or one or more of the delivery lines may be connected directly to both the mixer and the metering device.

Optionally, a heating unit (not shown) may be used to heat the proppant, such as sand before being introduced into the metering device. Additionally, a vent (107) may be used for release of any vapors or gases generated during the manufacturing process. Other equipment used by the methods and systems of the application, but not shown, include but are not limited to storage compartments, power generating equipment, power switching equipment, process control system, air handling equipment, including but not limited to cyclone separators and rotary valves, equipment to introduce the coating components into the mixer as well as equipment to meter same, and the like.

The metering device, in some embodiments may employ weigh cells. Where a weigh cell is not practical, a flow meter may be employed. Any method of metering the flow of proppant may be employed if known to be useful to those of ordinary skill in the art. Suitable metering devices, include, and are not limited to, a weigh cell, a dry flow meter, a weigh belt, or combinations thereof. The metering devices are configured to measure the rate of addition of proppant to the system, any liquid feed streams, and any solid feed streams.

While it is possible to do the coating at ambient temperatures, it is desirable to heat the proppant and dust control agents in at least some embodiments of the method of the application. While it is possible to heat at least some coating components up to about 500° F. or even higher, in many embodiments, it will be necessary to only heat in the range of from about 100° F. to about 225° F. In one embodiment, the admixture of proppant and dust control agent is heated from the top down using a dispersion plate. Heat can be provided in any way known to be useful and safe to those of ordinary skill in the art. While steam is generally not desirable due to the water it would introduce to the system, other sources of heat such as, but not limited to hot oil jackets, plate heaters, plasma heaters, direct flame heaters, radiant heaters, electric heating elements, and even microwave heaters may be so employed.

The mixing of the proppant and agents is performed using any type of mixing vessel, such as impeller/paddle/blades mixers known to those of ordinary skill in the art. Such devices include, but are not limited to a paddle style mixer, a Ribbon mixer, a Planetary mixer, a Plow mixer, a Double Arm/Sigma mixer, a z blade mixer, a trough mixer and Vertical, High shear mixing blades/impellers.

The dust control agents may be introduced using any method/equipment known to those of ordinary skill in the art. In one embodiment, the dust control agents are added at a desired rate by utilizing chemical transfer pumps. The types of pumps used in the system could include centrifugal, peristaltic, piston, rotary, gear, screw, progressive cavity, compressed air powered, roots-type, radial, axial, or gravity. Flow meters may also be required. Flow meters which could be utilized in the process include, but are not limited to orifice, venturi, nozzle, rotameter, Pitot tube, turbine, vortex, electromagnetic, ultrasonic, positive displacement, thermal, and coriolis. Other controls include proximity switches, current transmitters, variable frequency drives, automatic valves, and load cells.

Once the chemical has been added and given time to react the material is discharged at the end of the mixing system into a pneumatic sand conveying system. The sand could also be conveyed by belt, screw, chain, and vibratory. Residence time will be a function of throughput. Desirably, the devices will be sized to permit full scale use with a predetermined residence time selected as a function of the material used to coat the proppant and the temperatures to be used. In one embodiment, the throughput will be from about 1000 pounds to about 200 thousand pounds per hour, more specifically 40 to 70 thousand pounds. In other embodiments, the throughput will be about 60 thousand pounds per hour. The proppant process method may be a continuous process, a semi-continuous process, or a batch process, with preferably a continuous process being used.

In one embodiment of the coating application process, proppant enters the metering device (102) via the inlet (101) so that a precise measurement of the amount of proppant is determined and then passes through to the mixer (104). Chemicals including the dust controlling agent are provided from chemical sources to the metering device (102) through one or more inlets (103*a*-103*d*). It is anticipated that this system would be used continuously so at the same time as the proppant is entering the mixer, the components used to coat the proppants would be entering the mixer via the other inlets. Chemicals from the chemical sources may be added together at one time or added at different times, such as sequentially, sources Once fed into the mixer, the proppant and the dust control agent and/or other chemicals agents would be brought into contact with sufficient shear to at least partially coat as much of the proppant as is necessary to achieve dust control and/or flowback control. The coated proppants would then leave the mixer (104) by the outlet (105) for delivery to the site of use.

Figure 2:
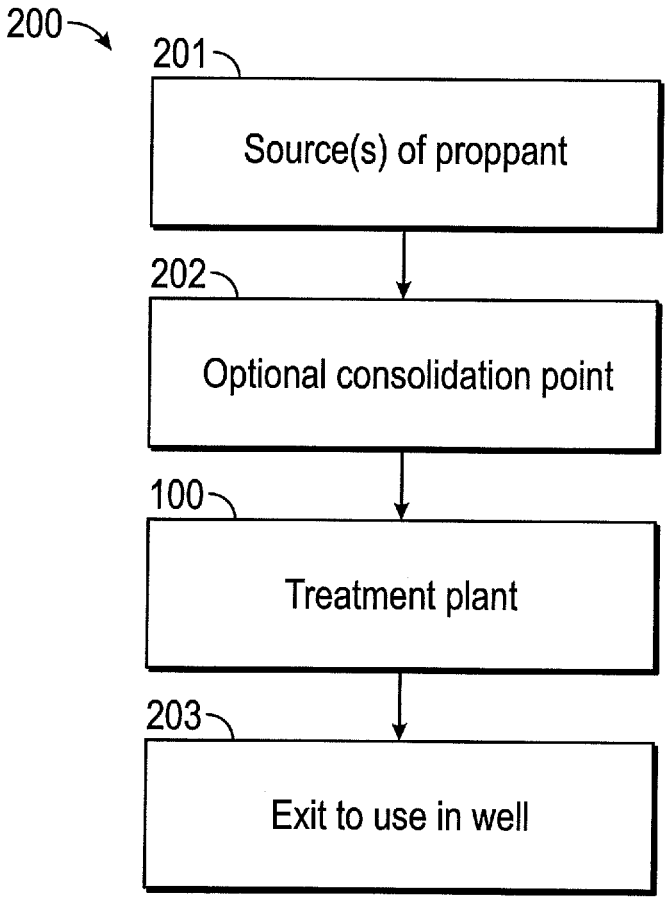
FIG. 2 is a flow diagram showing the passage of proppant into and out of the system of the application.

During fracking operations, generally a supply of proppant is brought to the well site using bulk trucks or supersacks. Shipments may be consolidated in a consolidation point, for example, a surge pit, a surge bin, a storage container, a truck, a pneumatic container or the like. In one embodiment of the method of the invention, the proppant would be introduced into the inlet port (101) from either the bulk delivery vehicles or the optional consolidation point, often using a pneumatic conveyor. Turning to FIG. 2, this is illustrated where (201) represents the device or container bringing the proppant to the well site, (202) represents the optional consolidation point where material is placed prior to use, (100) is the mixing device illustrated in FIG. 1, and (203) represents an optional collection point downstream of the exit/outlet point (105) on the mixer (100). In some embodiments, there may not be a consolidation point.

Turning to FIG. 4, an embodiment of the system (400) disposed on a mobile platform (401), such as a semitrailer or a shipping container is shown. In this embodiment, a tank (406), having inlet port (405) disposed thereon, is configured to receive proppant from a proppant source (not shown) at the site. A metering device (402) is coupled to the tank (406), and is adapted to receive a proppant. A conveyor (403) coupled to the metering device (402) and a mixer (404), is configured to convey the proppant into the mixer (404). The mixer is coupled to sources (413) via delivery lines (412) to receive chemicals to coat the proppant, and any number of delivery lines and sources may be used, of which 5 sources (413*a*)-(413*e*) and the respective delivery lines (412*a*)-(412*e*) are shown in FIG. 4. The sources (413) may contain materials in liquid or solid forms. Examples of sources include a resin source, acid catalyst source, a coupling agent, a dust control agent source, and a surfactant source. While not shown, each of the delivery lines (412) may include devices for metering the amount of material added to the mixer or shutting off the flow of material added to the mixer, such as by a valve. The metering devices for the various chemicals may be located in a separate chemical truck that holds the chemicals for delivery into the mixing unit. Alternatively, the chemicals and metering devices for the chemicals may be in the same unit/container as the mixer. Further, while not shown, one or more of the delivery lines may be connected directly to the metering device.

The mixer (404) further includes a mixer discharge (409). The mixer discharge (409) may be coupled to the use site, such as a wellbore at a wellsite, through hoses, piping, or any other delivery systems and methods known to those of ordinary skill in the art including, but not limited to a pneumatic sand conveying system, a belt, screw, chain, and even a vibratory conveyance system. From this point, the coated proppant would be used as normal in a fracking or other process.

An optional heating unit or units, such as heating unit (410) may be disposed on the mixer. A heating unit (not shown) may be used to heat the proppant, such as sand before being introduced into the metering device. The heating unit, or two or more heating units, may also be configured to can heat the proppant and the mixer. A heating unit is optional since it may not be necessary to heat the proppant depending on the exact ambient temperature and the formulation used, and in view that proppant may come at or above desired coating temperature from a proppant supplier after passing through a dryer. Additionally, a vent (411) may be used for release of any vapors or gases generated during the manufacturing process.

In one embodiment of the operation of the system (400) of FIG. 4 installed on a mobile platform (401), such as a semitrailer or a shipping container is shown. In this embodiment, the proppant from a proppant source (not shown) at the site is delivered, such as being blown, through inlet port (405) into the tank (406), for example, a hopper. The proppant is then delivered to the metering device, which is coupled to the tank (406) directly or through one or more intermediate devices. In FIG. 4, the proppant is disposed on a weigh belt or bulk metering device (402), and then enters the inlet of a conveyor (403), such as a feeder screw, and is conveyed up and into the mixer (404). The materials used to coat the proppant are delivered from sources via delivery lines into the mixer, and any number of delivery lines and sources may be used. For example in one embodiment shown in FIG. 4, material used to coat the proppant is delivered from sources (413*a*)-(413*e*) via delivery lines (412*a*)-(412*e*). The coated proppants from the mixer are then discharged through the mixer discharge (409). The sources may contain materials in liquid or solid forms. The mixer is coupled to the sources through the delivery lines. Examples of sources include a resin source, acid catalyst source, a coupling agent, a dust control agent source, and a surfactant source.

During the method of the application, dust is collected from the tank/hopper via a tube (407) by the dust collector (408). The dust collected may be recycled (not shown) back into the mixer (404) and coated. Other equipment used by the methods and systems of the application, but not shown, include but are not limited to storage compartments, power generating equipment, power switching equipment, process control system, air handling equipment, including but not limited to cyclone separators and rotary valves, equipment to introduce the coating components into the mixer as well as equipment to meter same, and the like.

It would be desirable to employ safety devices to prevent accidents such as fires and explosions. In one embodiment of the method of the application, the mixer is heated using a flow of air. In order to avoid bringing possibly explosive fumes into a heater, the mixer would be vented, such as vents (107) and (411) in the figures. In this embodiment, it may be desirable to use a filter system to retain dust within the mixer.

In an example of one embodiment of a coating process using the devices from either FIG. 1 or FIG. 4, a proppant is heated for a period of time. The heated proppant is transferred to a mixer. In the mixer, one or more dust control agents and any other chemicals needing for the coating process are added. After a mixing time the mixing was stopped, and the product discharged. The one or more dust control agents and other chemicals may be added concurrently, for example, as shown in Example 8 below, or may be added sequentially, for example, as shown in Example 10 below.

While the method of the application can be performed using manual control, it may be desirable to automate the system as much as possible. Controllers (either dedicated or computer based), having sufficient capacity or bandwidth to control the introduction of proppant and its metering, the introduction of dust control agents and the metering associated with these agents, control the motor driving the mixer, monitor process temperatures, monitor residence time and control treated proppant removal may be employed.

In another embodiment, the invention is a mobile system for treating proppant, with a chemical coating, the system comprising a metering device configured to receive the proppant; a mixer configured to receive the proppant from the metering device, wherein the mixing device is further configured to receive at least one liquid or solid feed stream of chemical coating compound, and substantially the entirety of the system is disposed within a container which can be placed on a vehicle or is integrated within a vehicle. In one embodiment, the mixer and all of the supporting equipment (heaters, vacuum source, generators, and the like) may be installed within a shipping container. Such containers are of standard sizes and are easily moved by trucks. In an alternative embodiment, the mixer and other equipment may be built onto a truck or other self-powered vehicle. The proppant for coating by the mobile system may be transported to a destination near the structure for the use of the proppant, such as a well site a mine, or any other similar structure.

In one embodiment of the operation of a mobile system may be as follows. The system, such as shown in FIG. 1 (100) or FIG. 4 (400), is mounted or assembled on a mobile platform, such as (401). The system is then provided to an end use site, such as a well, wellbore, or other structure. At the end use site, the system is configured to produce a desired coated proppant and deliver the desired coated proppant to a device for storage and later use, or is configured to produce a desired coated proppant and coupled to the end use site to provide the desired coated proppant directly to the structure. Then the system is activated to produce the desired coated proppant, and the desired coated proppant is delivered to storage or the end use structure.

In one aspect, the invention is a method of conducting a hydraulic fracturing operation on an oil or gas well including treating a proppant that has been transported to a well site with a chemical coating at level sufficient to prevent or at least mitigate the formation of dust during handling of the proppant.

While many of the embodiments of the application do occur at the well site or similar structure, the proppant may also be coated at other locations. This is especially true where there is insufficient space at the well site. For example, especially where the proppant is sand, the proppant may be treated where it is mined or further treated. For example where the proppant is a ceramic, the proppant may be treated at the ceramic manufacturer.

EXAMPLES

The following examples are provided to illustrate aspects of the invention. The examples are not intended to limit the scope of the invention and they should not be so interpreted. Amounts are in weight parts or weight percentages unless otherwise indicated.

Ball Milling Test Method

The dust levels of particles can be determined for particles subjected to a Ball Mill Test using a Turbidity Test. The particles are processed in the Ball Mill as follows. Into a standard eight inch ball mill, three ceramic balls (about 2 inches in diameter) are added along with 150 grams of the material to be tested. This combination is closed and placed on the rollers at about 50 rpm. The unit is stopped at specific times, samples removed, and subjected to the Turbidity Test as described below. After being subjected to the Ball Mill Test the particles are subjected to a Turbidity Test as follows.

Turbidity Test Method

Equipment: 1) Turbidity meter: Hach Model 2100P 2) Gelex secondary standards 3) vortex mixer: Thermolyne Maxi-Mix 1 or equivalent 4) sample cells, screw caps: Hach catalog #21228 or equivalent 5) lint free paper 6) digital top loading electronic balance.

Reagents: 1) deionized/distilled water, doped with 0.1% FSO surfactant or FS-34 surfactant, 15 grams (referred to as doped water herein); 2) DuPont™ ZONYL®. FSO Fluorosurfactant or DuPont™ Capstone® FS-34; 3) sample to be measured, 5.00 grams.

Determinations: The turbidimeter should be calibrated daily. 1) Weigh 15.0 grams of doped water into a clean sample cell and replace the cap. 2) Wipe outside of the cell with lint free paper 3) Make sure no air bubbles adhere to the walls of the cell. 4) Place the cell into the turbidimeter and read the turbidity in NTU units. 5) Weigh 5.00 grams of the sample to be measured and place this in the cell from step 4 above. 6) Using the Vortex mixer, agitate the sample/water mixture for 10 seconds. 7) Again, clean the outside of the cell with lint free paper. 8) Place the sample/cell back into the turbidimeter and read the turbidity, 30 seconds after the Vortex mixing ended. 9) Record the turbidity in NTU units for this sample as "dust content."

The silane is (3-glycidyloxypropyl)trimethoxysilane adhesion promoter manufactured by Shin Etsu of Akron, Ohio. Toluene is added a solvent. Benzoyl peroxide are added as a initiator.

Oil Well Resin 9200, SL-1116E and OWR-262E are manufactured by Hexion Inc. of Louisville, Ky.

The Ball Mill Test is assumed to simulate the likely amount of dust generated during transportation and pneumatic transfer. The amount of dust generated is measured via the Turbidity Test.

Unconfined Compressive Strength

The terms "cured" and "curable" may be defined for the present specification by the bond strength of the surface material. In one embodiment described herein, curable is any surface material having a UCS Bond Strength of 1 psi or greater and/or capable of forming a core.

Compressive strength of curable proppants is defined as that measured according to the following procedure, known as the Unconfined Compressive Strength or UCS test. In this test, proppant is added to a 2 weight percent KCl solution doped with a small amount of detergent to enhance wettability. The KCl solution and proppant, such as from about 6 to about 18 lbs., typically about 12 lbs. proppant per gallon KCl, are gently agitated to wet the proppant. Remove entrained air bubbles, if any. If necessary use a wetting agent to remove the bubbles. This slurry from about 100 to about 200 grams depending on density) is transferred into duplicate 1.25 inch outside diameter, 10 inch stainless steel cylinders, equipped with valves on the top and bottom to bleed liquid and gas pressure as required, a pressure gauge reading 0 to 2000 psi, and a floating piston to transfer pressure to the sample. Typically at least 2, preferably at least 3 specimen molds are loaded to give a length greater than two times the diameter of the finished slug. The bottom valve is opened during the application of stress, allowing fluid to drain from the slurry, and then closed during the application of temperature. The cylinder is connected to a nitrogen cylinder and 1000 psi is imposed on the cylinder, transmitted by the sliding pistons to the sample, and then top valve is shut and bottom valve remains open. As test temperature is approached near to the fluid valve on the mold, the bottom valve (fluid valve) is closed. Closing the fluid valve too soon may generate enough pressure, as the cell is heating, to prevent/reduce the intended closure stress applied to the proppant slug. Closing the valve too late may allow loss of too much fluid from the slug by evaporation or boiling.

The duplicate cylinders containing the sample are transferred to an oven preheated to the desired setpoint, for example, 200° F., and remain in the oven for 24 hours. Maintain stress and temperature during the cure time. Stress should be maintained +−10%. During the curing process in the oven, loose curable proppant particles become a consolidated mass. At the end of the 24 hours, the cylinders are removed, venting off pressure and fluid rapidly, and the approximately one inch by six inch consolidated slug sample is pressed from the cylinder. The sample is allowed to cool and air dry for about 24 hours, and cut (typically sawed) into compression slugs of length times diameter (L×D) of greater than 2:1, preferably about 2.5:1. Air drying is performed at a temperature of less than about 49° C. (120° F.). Typically, both ends of each slug are smoothed to give flat parallel surfaces and the slugs are cut to maintain a greater than 2:1 ratio of the length:diameter.

The compression slugs are mounted in a hydraulic press and force is applied between parallel platens at a rate of about 4000 $lbs_f$/minute until the slug breaks. For slugs with compressive strength less than 500 psi, use a loading rate of about 1000 $lbs_f$/minute. The force required to break the slug is recorded, replicates are documented, and the compressive strength for each sample is calculated using the formula below. An average of the replicates is used to define the value for this resin coated proppant sample. (Fc, psi) =4.times.Fg/{(p.times.d.times.d)[0.88+(0.24 d/h)]} wherein Fc=compressive strength (psi) Fg=hydraulic gauge reading (lb force) p=pi (3.14) d=diameter of the slug (inches) h=length of slug (inches).

Compressive strength of the slugs is determined using a hydraulic press, i.e., Carver Hydraulic Press, model #3912, Wabash, Ind. Typical compressive strengths of proppants of the present invention range from about 10 to about 100 psi or higher. However, the reproducibility of the UCS test is probably +−10% at best. It is also noted that the Compressive Strength Test can be used to indicate if a coating is cured or curable. No bonding, or no consolidation of the coated particles, following wet compression at 1000 psi at 200° F. for a period of as much as 24 hours, indicates a cured material.

The molded specimens made according to this procedure are suitable for measurement of Brazilian tensile strength and/or unconfined compressive strength (UCS) test of ASTM D 2938-91 or ASTM D 2938-95 Standard Test Method for Unconfined Compressive Strength of Intact Rock Core Specimens. For compressive strength measurements, the test specimen shall be cut to a length of at least 2.25 inches (57.2 mm), a length to diameter ratio of at least 2 to 1, and then broken according to ASTM D 2938-91 Standard Test Method for Unconfined Compressive Strength of Intact Rock Core Specimens. For Brazilian tensile strength measurements, the test specimen shall be cut to a length of at least 0.56 inch (14.2 mm) but not more than 0.85 inch (21.6 mm), a length to diameter ratio of at least 0.5-0.75 to 1, according to ASTM D 3967-92 Standard Test Method for Splitting Tensile Strength of Intact Rock Core Specimens.

Figure 3:
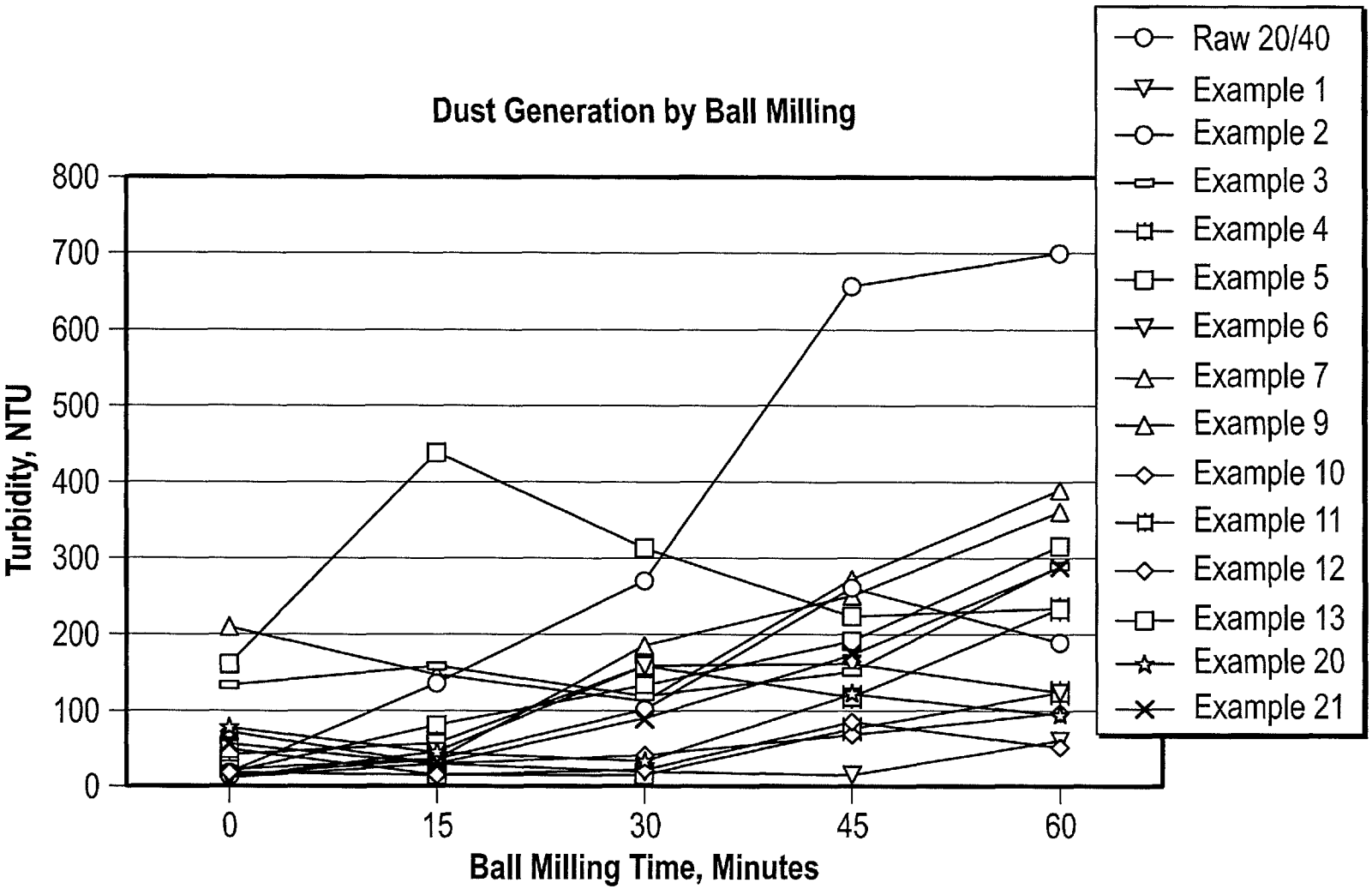
FIG. 3 is a graph showing results from the examples illustrating a reduction in dust generation by the present invention over raw sand.

Test Data is shown below in the Table and in FIG. 3.

Example 1

This example employs 1 kg of 20/40 Brown Hickory sand with a single layer coating of SM2059 (aminoethylaminopropyl polysiloxane emulsion) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and 2.5 g of SM2059 was added at the start of the mixing process. After a total mixing time of 4 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 2

This example employs 1 kg of 20/40 Brown Hickory sand with a single layer coating of SM2725 (emulsion of dimethylhydroxyterminated siloxanes and silicones) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and 1.82 g of SM2725 was added at the start of the mixing process. After a total mixing time of 4 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 3

This example employs 1 kg of 20/40 Brown Hickory sand with a single layer coating of XS65-B7991 (aqueous polysiloxane emulsion) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and 2.0 g of XS65-B7991 was added at the start of the mixing process. After a total mixing time of 4 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 4

This example employs 1 kg of 20/40 Brown Hickory sand with a single layer coating of Silsoft EM 160-A-SM (dimethiconol emulsion) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and 4.0 g of Silsoft EM 160-A-SM was added at the start of the mixing process. After a total mixing time of 10 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 5

This example employs 1 kg of 20/40 Brown Hickory sand with a single layer coating of SM2169 (polydimethylsiloxane emulsion) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and 2.0 g of SM2169 was added at the start of the mixing process. After a total mixing time of 4 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 6

This example employs 1 kg of 20/40 Brown Hickory sand with a single layer coating of Y-17953 (alkyl branched and vinyl polysiloxanes) available from Momentive Performance Materials of Tarrytown, N.Y. The sand was stored at ambient temperature (70° F.) prior to coating. The sand was transferred to a Hobart lab mixer. The mixer agitator was started and 2.0 g of Y-17953 was added at the start of the mixing process. After a total mixing time of 4 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 7

This example employs 1 kg of 20/40 Brown Hickory sand with a single layer coating of PSA6573A (toluene solution of polysiloxane gum and resin) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and 4.0 g of PSA6573A, into which 0.2 g of benzoyl peroxide was premixed, was added at the start of the mixing process. After a total mixing time of 4 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 8

This example employs 1 kg of 20/40 Brown Hickory sand with a single layer coating of PSA6573A (toluene solution of polysiloxane gum and resin) available from Momentive Performance Materials of Tarrytown, N.Y. The sand was heated at a temperature of 150° F. in a conventional oven for at least 18 hours. The heated sand was transferred to a Hobart lab mixer. The mixer agitator was started and a mixture of 4.0 g of PSA6573A, 0.2 g of benzoyl peroxide, and 4.0 g of toluene was added at the start of the mixing process. After a total mixing time of 4 minutes the mixing was stopped, the coated material was passed through a no. 16 US mesh sieve and the product was tested for 24 hour UCS bond strength at 1000 psi and 200° F. There is no Turbidity data in the Table for Example 8. The only difference between Example 8 and Example 7 is pre-mixing of the benzoyl peroxide and PSA6573A in Example 7.

Example 9

This example employs 1 kg of 20/40 Brown Hickory sand with a single layer coating of Rovene 4423 (anionic emulsion of carboxylated styrene butadiene) available from Mallard Creek Polymers of Charlotte, N.C. The sand was heated at a temperature of 150° F. in a conventional oven for at least 18 hours. The heated sand was transferred to a Hobart lab mixer. The mixer agitator was started and 4.0 g of Rovene 4423 was added at the start of the mixing process. After a total mixing time of 5 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 10

This example employs 1 kg of 20/40 Brown Hickory sand with a single layer coating of Oil Well Resin 9200 phenolic resin available from Hexion Inc. of Louisville, Ky. The sand was heated at a temperature of 150° F. in a conventional oven for at least 18 hours. The heated sand was transferred to a Hobart lab mixer. The mixer agitator was started and 1.0 g of (3-glycidyloxypropyl)trimethoxysilane was added at the start of the mixing process. Next, 9.6 g of OWR 9200 was added at the 15 second mark, followed by 1.05 g of 65% p-toluenesulfonic acid at the 45 second mark and 2.0 g of Y-17953 at the 4 minute mark. After a total mixing time of 6 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 11

This example employs 1 kg of 20/40 Brown Hickory sand with a single layer coating of SL-1116E phenolic resin available from Hexion Inc. of Louisville, Ky., Kentucky. The sand was heated at a temperature of 150° F. in a conventional oven for at least 18 hours. The heated sand was transferred to a Hobart lab mixer. The mixer agitator was started and 1.0 g of (3-glycidyloxypropyl)trimethoxysilane was added at the start of the mixing process. Next, 8.2 g of SL-1116E was added at the 15 second mark, followed by 1.17 g of 65% p-toluenesulfonic acid at the 45 second mark and 2.0 g of Y-17953 at the 4 minute mark. After a total mixing time of 6 minutes, the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 12

This example employs 1 kg of 20/40 Brown Hickory sand with a single layer coating of OWR-262E phenolic resin available from Hexion Inc. of Louisville, Ky. The sand was heated at a temperature of 150° F. in a conventional oven for at least 18 hours. The heated sand was transferred to a Hobart lab mixer. The mixer agitator was started and 1.0 g of (3-glycidyloxypropyl)trimethoxysilane was added at the start of the mixing process. Next, 9.6 g of OWR-262E was added at the 15 second mark, followed by 1.3 g of 65% p-toluenesulfonic acid at the 45 second mark and 0.5 g of Y-17953 at the 3 minutes and 30 seconds mark. After a total mixing time of 5 minutes and 30 seconds, the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 13

This example employs 1 kg of 20/40 Brown Hickory sand with a single layer coating of Synthebond 9300 resin available from Hexion Inc. of Roebuck, S.C. The sand was heated at a temperature of 150° F. in a conventional oven for at least 18 hours. The heated sand was transferred to a Hobart lab mixer. The mixer agitator was started and 6.0 g of Synthebond 9300 was added at the start of the mixing process. At the 1 minute mark, 1.0 g of Y-17953 was added. After a total mixing time of 3 minutes the mixing was stopped, the coated material was passed through a no. 16 US mesh sieve, then Ball Milling test was performed on the coated material to check for dust suppression and the product was tested for 24 hour UCS bond strength at 1000 psi and 200° F.

Example 14

This example employs 1 kg of 20/40 Brown Hickory sand with a single layer coating of Snowtack 100G (stabilized rosin ester) available from Lawter of Baxley, Ga. The sand was heated at a temperature of 150° F. in a conventional oven for at least 18 hours. The heated sand was transferred to a Hobart lab mixer. The mixer agitator was started and 8.0 g of Snowtack 100G was added at the start of the mixing process. After a total mixing time of 3 minutes the mixing was stopped, the coated material was passed through a no. 16 US mesh sieve and the product was tested for 24 hour UCS bond strength at 1000 psi and 200° F.

Example 15

This example employs 1 kg of 20/40 Brown Hickory sand with a single layer coating of Pinerez 2490 (rosin ester) available from Lawter of Baxley, Ga. The sand was heated at a temperature of 225° F. in a conventional oven for at least 18 hours. The heated sand was transferred to a Hobart lab mixer. The mixer agitator was started and 4.0 g of Pinerez 2490 was added at the start of the mixing process. After a total mixing time of 3 minutes the mixing was stopped, the coated material was passed through a no. 16 US mesh sieve and the product was tested for 24 hour UCS bond strength at 1000 psi and 200° F.

Example 16

This example employs 1 kg of 20/40 Brown Hickory sand with a single layer coating of OWR-262E phenolic resin available from Hexion Inc., of Louisville, Ky. The sand was heated at a temperature of 110° F. in a conventional oven for at least 18 hours. The heated sand was transferred to a Hobart lab mixer. The mixer agitator was started and 7.0 g of OWR-262E was added at the start of the mixing process. Next, 7.0 g of Snowtack 100G was added at the 90 second mark. After a total mixing time of 3 minutes and 30 seconds, the mixing was stopped, the coated material was passed through a no. 16 US mesh sieve and the product was tested for 24 hour UCS bond strength at 1000 psi and 200° F.

Example 17

This example employs 1 kg of 20/40 Brown Hickory sand with a single layer coating Neoprene 571 (anionic colloidal dispersion of polychloroprene in water) available from DuPont Performance Elastomers. The sand was heated at a temperature of 130° F. in a conventional oven for at least 18 hours. The heated sand was transferred to a Hobart lab mixer. The mixer agitator was started and 8.0 g of Neoprene 571 was added at the start of the mixing process. After a total mixing time of 2 minutes the mixing was stopped, the coated material was passed through a no. 16 US mesh sieve and the product was tested for 24 hour UCS bond strength at 1000 psi and 200° F.

Example 18

This example employs 1 kg of 20/40 Brown Hickory sand with a single layer coating of OWR-262E phenolic resin available from Hexion Inc., of Louisville, Ky. and an additional layer of Neoprene 571 (anionic colloidal dispersion of polychloroprene in water) available from DuPont Performance Elastomers. The sand was heated at a temperature of 140° F. in a conventional oven for at least 18 hours. The heated sand was transferred to a Hobart lab mixer. The mixer agitator was started and 1.0 g of (3-glycidyloxypropyl) trimethoxysilane was added at the start of the mixing process. Next, 8.0 g of OWR-262E was added at the 15 second mark and 7.0 g of Neoprene 571 was added at the 90 second mark. After a total mixing time of 3 minutes, the mixing was stopped, the coated material was passed through a no. 16 US mesh sieve and the product was tested for 24 hour UCS bond strength at 1000 psi and 200° F.

Example 19

This example employs 1 kg of 20/40 Brown Hickory sand with a single layer coating of Neoprene 571 (anionic colloidal dispersion of polychloroprene in water) available from DuPont Performance Elastomers and an additional layer of OWR 9200 phenolic resin available from Hexion Inc., of Louisville, Ky. The sand was heated at a temperature of 127° F. in a conventional oven for at least 18 hours. The heated sand was transferred to a Hobart lab mixer. The mixer agitator was started and 1.0 g of (3-glycidyloxypropyl) trimethoxysilane was added at the start of the mixing process. Next, 4.0 g of Neoprene 571 was added at the 15 second mark, 9.6 g of OWR 9200 was added at the 2 minutes mark, and 1.1 g of 65% p-toluenesulfonic acid was added at the 2 minutes and 30 seconds mark. After a total mixing time of 4 minutes, the mixing was stopped, the coated material was passed through a no. 16 US mesh sieve and the product was tested for 24 hour UCS bond strength at 1000 psi and 200° F.

Example 20

This example employs 1 kg of 100 mesh white sand with a single layer coating of OWR-262E phenolic resin available from Hexion Inc., of Louisville, Ky., an additional layer of Y-17953 (alkyl branched and vinyl polysiloxanes) available from Momentive PerformanceMaterials of Tarrytown, N.Y. and a surfactant, Aerosol® OT-70 PG (sodium dioctyl sulfosuccinate) available from Cytec of Woodland Park, N.J. The sand was transferred to a Little Ford mixer and heated with a heat gun to 135° F. while mixing at a setting of 75 Hz. Next, 1.0 g of (3-glycidyloxypropyl)trimethoxysilane was added at the time designated zero. At the 15 second mark, 14.30 g of OWR-262E resin was added, followed by 2.38 g of 65% p-toluenesulfonic acid at the 45 second mark, 0.90 g of Y-17953 at the 3 minute mark, and 0.20 g of OT-70 at the 3 minute and 30 seconds mark. After a total mixing time of 4 minutes and 15 seconds, the coated material was discharged from the mixer and the product was tested for 24 hour UCS bond strength at 1000 psi and 200° F.

Example 21

This example employs 1 kg of 100 mesh white sand with a single layer coating of OWR-262E phenolic resin available from Hexion Inc., of Louisville, Ky., an additional layer of Y-17953 (alkyl branched and vinyl polysiloxanes) available from Momentive Performance Materials of Tarrytown, N.Y. and a surfactant, Aerosol® OT-75 PG (sodium dioctyl sulfosuccinate) available from Cytec of Woodland Park, N.J. The sand was transferred to a Little Ford mixer and heated with a heat gun to 135° F. while mixing at a setting of 75 Hz. Next, 0.67 g of (3-glycidyloxypropyl)trimethoxysilane was added at the time designated zero. At the 15 second mark, 11.69 g of OWR-262E resin was added, followed by 1.94 g of 65% p-toluenesulfonic acid at the 45 second mark, 0.16 g of Y-17953 at the 3 minute mark, and 0.40 g of OT-75 at the 3 minute and 30 seconds mark. After a total mixing time of 4 minutes and 15 seconds, the coated material was discharged from the mixer and the product was tested for 24 hour UCS bond strength at 1000 psi and 200° F.

Table 1 illustrates the reduction in dust achieved by the inventive mobile system for treating proppant. Depending on the processing conditions used to produce sand for hydraulic fracturing applications, the sand can be inherently dusty. Additional dust can be generated as the sand is transferred from mining operations to a delivery truck or supersack and transported to a well site. Furthermore, when sand is transferred from a delivery truck or supersacks to a consolidation point and to a transfer belt and blender at the well site, the mechanical abrasion to which the sand is exposed can result in the generation of significant respirable dust.

The turbidity measurements shown in Table 1 illustrate the level of dust generated upon exposure of raw sand and treated sand to simulated abrasion in the ball mill test. After 60 minutes of abrasion in the ball mill test, raw 20/40 sand exhibits a turbidity of 698 NTU, indicating a high dust level. By comparison, 20/40 sand treated by the inventive process shows a reduction in turbidity of about 45% to 92%. An exemplary illustration is Example 10 which shows an 86% reduction in generated dust, which is expected to make handling of the treated proppant safer than raw sand because of the concomitant reduction in respirable dust, and exhibits a UCS of 94 psi, which is expected to reduce the flow back of the treated proppant significantly. After 60 minutes of abrasion in the ball mill test, raw 100 mesh sand exhibits a turbidity of greater than 1000 NTU, indicating a very high dust level. By comparison, 100 mesh sand treated by the inventive process shows a reduction in turbidity of greater than about 71% to 91% after 60 minutes. An exemplary illustration is Example 20 which reduced generated dust by about 91%, which is expected to make handling of the treated proppant safer than raw sand because of the concomitant reduction in respirable dust, and exhibits a UCS of 22 psi, which is expected to reduce the flow back of the treated proppant significantly.

TABLE 1

| Sample Analysis | | | | | | |
|---|---|---|---|---|---|---|
| | Turbidity (NTU) Ball Milling (minutes) | | | | | UCS |
| Examples | 0 | 15 | 30 | 45 | 60 | psi |
| Raw 20/40 (comparison) | 15 | 135 | 269 | 656 | 698 | U |
| Example 1 | 5 | 45 | 156 | 160 | 126 | U |
| Example 2 | 15 | 35 | 99 | 255 | 190 | U |
| Example 3 | 134 | 159 | 121 | 152 | 291 | U |
| Example 4 | 38 | 56 | 156 | 117 | 233 | U |
| Example 5 | 162 | 439 | 311 | 223 | 234 | U |
| Example 6 | 9 | 21 | 15 | 17 | 59 | U |
| Example 7 | 20 | 34 | 184 | 248 | 360 | C |
| Example 8 | — | — | — | — | — | C |
| Example 9 | 208 | 149 | 112 | 271 | 387 | C |
| Example 10 | 73 | 26 | 42 | 68 | 98 | 94 |
| Example 11 | 44 | 8 | 11 | 72 | 123 | 12 |
| Example 12 | 31 | 11 | 21 | 79 | 53 | 48 |
| Example 13 | 17 | 79 | 130 | 189 | 314 | C |
| Example 14 | — | — | — | — | — | C |
| Example 15 | — | — | — | — | — | 7 |
| Example 16 | — | — | — | — | — | 8 |
| Example 17 | — | — | — | — | — | C |
| Example 18 | — | — | — | — | — | 7 |
| Example 19 | — | — | — | — | — | 7 |
| 100 mesh raw sand | 268 | 477 | 761 | 1000 | >1000 | U |
| Example 20 | 75 | 42 | 33 | 121 | 93 | 22 |
| Example 21 | 57 | 33 | 89 | 173 | 287 | 14 |

U = Unconsolidated UCS core
C = Consolidated UCS core, but no measurable strength While the present invention has been described and illustrated by reference to particular embodiments, those of ordinary skill in the art will appreciate that the invention lends itself to variations not necessarily illustrated herein.

What is claimed is:

1. A mobile system for treating a proppant, the system comprising:

two or more metering devices each configured with an inlet port, and the two or more metering devices receive at least a proppant and one or more material streams selected from the group of liquid feed streams, solid feed streams, and combinations thereof;

a mixer directly connected to the two or more metering devices by delivery lines and configured to receive materials from the two or more metering devices;

a heating unit disposed on the mixer;

a dust collector coupled to the mixer;

and a mobile platform which the two or more metering devices and the mixer are disposed on or integrated within, wherein the mixer further comprises an outlet port configured to transfer materials from the mixer to an end site use, wherein the system is continuous processing system and wherein the heating unit is adapted to heat materials in the mixer.

2. The mobile system of claim 1 wherein the mobile system is further disposed within a container which can be placed on or coupled to a vehicle, is further disposed on a vehicle, or is further integrated within a vehicle.

3. The mobile system of claim 1, wherein at least one of the two or more metering devices is coupled to a tank, and is adapted to receive a proppant.

4. The mobile system of claim 3, further comprising a conveyor coupled to the mixer and the metering device coupled to the tank.

5. The mobile system of claim 1 wherein the metering device is a weigh cell, a dry flow meter, or a weigh belt.

6. The mobile system of claim 1 wherein the heating unit is selected from the group consisting of hot oil jackets, plate heaters, plasma heaters, direct flame heaters, radiant heaters, electric heating elements, microwave heaters, and combinations thereof.

7. The mobile system of claim 1, wherein the mixer is selected from the group consisting of include Ribbon mixer, Planetary mixer, Plow mixer, Double Arm/Sigma mixer, z blade mixer, trough and Vertical mixer, High shear mixing blades/impellers mixer, and combinations thereof.

8. The mobile system of claim 1, wherein at least one of the two or more metering devices is configured on the mixer allowing for a gravity feed process from the metering device to the mixer.

9. The mobile system of claim 1, wherein the one or more material streams comprise one or materials selected from the group consisting of surfactants, gums, resins, thermoplastics, rubbers including synthetic rubbers, elastomers, thermoplastic elastomers, siloxanes, silicones and modified silicones, and combinations thereof.

10. The mobile system of claim 1, wherein the outlet port is directly connected to an end use site.

11. The mobile system of claim 1, wherein the inlet port of one of the two or more metering devices is directly connected to at least a proppant source and the inlet port of one of the two or more metering devices is directly connected to at least one chemical source, and wherein a pump is disposed between the at least one chemical source and one of the two or more metering devices.

12. The mobile system of claim 1, wherein the mobile system is further disposed within a container, and wherein the container is placed up on the vehicle.

13. A mobile system for treating a proppant comprising:

a tank configured to receive a proppant;

a metering device directly connected to the tank;

a conveyor directly connected to the metering device;

a mixer, wherein the mixer is configured to be:

directly connected to the conveyor and configured to receive materials from the conveyor, and directly connected to one or more delivery lines, wherein each delivery line is directly connected to a material source selected from the group of liquid sources, solid sources, and combinations thereof;

a heating unit disposed on the mixer;

a dust collector coupled to the mixer and coupled to the tank by a tube; and a mobile platform which the tank, the metering device, the conveyor, and the mixer are disposed on or integrated within, wherein the mixer further comprises a mixer discharge configured to transfer materials from the mixer to an end site, wherein the system is continuous processing system and wherein the heating unit is adapted to heat materials in the mixer.

14. The mobile system of claim 13 wherein the mobile system is further disposed within a container which can be placed on or coupled to a vehicle, is further disposed on a vehicle, or is further integrated within a vehicle.

15. The mobile system of claim 13 wherein the metering device is a weigh cell, a dry flow meter, or a weigh belt.

16. The mobile system of claim 13 wherein the mixer comprises a paddle style mixer.

17. The mobile system of claim 16 wherein the heating unit is selected from the group consisting of hot oil jackets, plate heaters, plasma heaters, direct flame heaters, radiant heaters, electric heating elements, microwave heaters, and combinations thereof.

18. The mobile system of claim 13, wherein the mixer is selected from the group consisting of include Ribbon mixer, Planetary mixer, Plow mixer, Double Arm/Sigma mixer, z blade mixer, trough and Vertical mixer, High shear mixing blades/impellers mixer, and combinations thereof.

19. The mobile system of claim 13, wherein each of the material sources independently comprises a material selected from the group consisting of surfactants, gums, resins, thermoplastics, rubbers including synthetic rubbers, elastomers, thermoplastic elastomers, siloxanes, silicones and modified silicones, and combinations thereof.

20. The mobile system of claim 19, wherein the mixer discharge is directly connected to an end use site.

21. The mobile system of claim 13, wherein the mobile system is further disposed within a container, and wherein the container is placed up on the a vehicle.

* * * * *